US006059693A

United States Patent [19]

Myers

[11] Patent Number: 6,059,693

[45] **Date of Patent: *May 9, 2000**

[54] WRIST RELIEF DEVICE

[75] Inventor: Douglas L. Myers, 6918 Queensgate St., NW., Canton, Ohio 44718

[73] Assignee: Douglas L. Myers, Canton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/610,990

[22] Filed: Mar. 5, 1996

[51] Int. Cl.[7] ..... A63B 23/14

[52] U.S. Cl. ..... 482/44

[58] Field of Search ..... 482/44, 91, 92, 482/121, 122, 124, 125, 131, 139, 148, 907; 601/33, 40; 602/32, 36; 606/241; 128/878, 879; 5/623, 646, 647

[56] References Cited

U.S. PATENT DOCUMENTS

| | | | |
|---|---|---|---|
| 2,675,564 | 4/1954 | Hughes | 5/628 |
| 2,819,081 | 1/1958 | Touraine . | |
| 2,954,026 | 9/1960 | Spinks . | |
| 3,355,171 | 11/1967 | Oesau . | |
| 4,010,744 | 3/1977 | Boyen . | |
| 4,057,246 | 11/1977 | Wilson | 482/125 |
| 4,258,913 | 3/1981 | Brentham . | |
| 4,383,524 | 5/1983 | Boger | 602/36 |
| 4,407,274 | 10/1983 | Goodley | 606/241 |
| 4,463,947 | 8/1984 | Kloenne . | |
| 4,506,883 | 3/1985 | Rathbun | 482/139 |
| 4,641,832 | 2/1987 | Mattox . | |
| 4,836,531 | 6/1989 | Niks . | |
| 4,930,767 | 6/1990 | Hamm . | |
| 4,940,066 | 7/1990 | Santilli et al. | 482/907 |
| 4,941,464 | 7/1990 | Scott . | |
| 5,090,691 | 2/1992 | Pollock | 482/139 |
| 5,230,679 | 7/1993 | Olsen . | |
| 5,256,136 | 10/1993 | Sucher . | |
| 5,263,916 | 11/1993 | Bobich | 482/124 |
| 5,271,617 | 12/1993 | Gilford . | |
| 5,366,436 | 11/1994 | Gibney . | |
| 5,380,259 | 1/1995 | Robertson et al. . | |
| 5,441,058 | 8/1995 | Fareed . | |
| 5,518,486 | 5/1996 | Sheeler | 482/907 |
| 5,569,135 | 10/1996 | Chen | 482/125 |

*Primary Examiner*—Richard J. Apley
*Assistant Examiner*—Lori Baker-Smith
*Attorney, Agent, or Firm*—Emerson & Associates; Roger D. Emerson

[57] ABSTRACT

A method and apparatus for stretching and exercising the wrist is disclosed. The apparatus includes a securing apparatus for securing the device to the wrist, a cord or strap, a footstep that enables the cord or strap to be secured to the floor, and an adjustment apparatus for adjusting the length of the cord or strap. The cord or strap wraps around the footstep for storage of the apparatus. The cord or strap is between 4 feet and 8 feet long and made of an inelastic material. The footstep may include a traction device for preventing slippage of the foot on the footstep. The method includes the steps of placing the wrist within the securing apparatus, tightening the securing apparatus, adjusting the length of the cord or strap using the adjustment apparatus so the footstep rests on the floor, placing the foot on the footstep to secure the footstep to the floor, and stretching the wrist.

12 Claims, 3 Drawing Sheets

WRIST RELIEF DEVICE

BACKGROUND OF THE INVENTION

1. Field of Invention

This invention pertains generally to the art of apparatuses and methods of stretching and exercising the wrist, and more specifically to an apparatus to stretch and exercise the carpal tunnel of the wrist without the need to grip the apparatus.

2. Description of the Related Art

Carpal tunnel syndrome is the result of the compression of the median nerve in the carpal tunnel in the wrist. The carpal tunnel is the canal through which the median nerve and the flexor tendons pass from the forearm to the hand.

Carpal tunnel syndrome is often treated with orthotics such as wrist splints or wrist rests, anti-inflammatory medication, cortisone shots, or surgery. Surgery is only a last-resort treatment for carpal tunnel syndrome and should be performed only in the most extreme cases. Orthotics often are bulky and prevent the carpal tunnel syndrome sufferer from performing tasks such as typing. Medications and steroids like cortisone may have adverse side effects and limited success. Carpal tunnel syndrome may also be prevented in some cases by enlarging the carpal tunnel through a system of stretching and manipulation exercises. Applicant has recognized the problems with the current methods of treatment of carpal tunnel syndrome and the need for non-invasive stretching and exercise of the wrist.

Past devices that have attempted to provide non-invasive treatment of carpal tunnel syndrome have included gloves, wrist bands or arm bands that must be worn. These devices may prove to be aesthetically not pleasing and bulky, preventing normal duties from being performed. Other stretching devices have been bulky and not easy to transport, limiting their usage and effectiveness.

The present invention contemplates a new and improved wrist relief and rehabilitation device which is simple in design, effective in use, and overcomes the foregoing difficulties and others while providing better and more advantageous overall results.

SUMMARY OF THE INVENTION

In accordance with the present invention, a new and improved wrist relief and rehabilitation device is provided which stretches and exercises the wrist of those that suffer from the pain of carpal tunnel syndrome.

More particularly, in accordance with the present invention, an apparatus for exercising the wrist includes a securing apparatus for securing the apparatus to the wrist, a footstep, and a pulling apparatus for pulling on the wrist. The pulling apparatus has an upper portion and a lower portion. The upper portion is attached to the securing apparatus, and the lower portion is attached to the footstep.

According to one aspect of the present invention method for stretching and exercising the wrist includes the steps of placing the wrist within the securing apparatus, securing the securing apparatus around the wrist, placing a foot on the footstep to secure the footstep to the floor, and stretching the wrist.

According to another aspect of the present invention a method of storing the wrist stretching apparatus includes the steps of wrapping the pulling apparatus around the footstep and wrapping the securing apparatus around the pulling apparatus and the footstep.

One advantage of the present invention is the ability to stretch the wrist and relieve the symptoms of carpal tunnel syndrome without gripping the device.

Another advantage of the present invention is the ability to easily and quickly adjust the device for different users.

Another advantage of the present invention is the ability to easily store the device when it is not in use.

Another advantage of the present invention is that the device does not limit day-to-day activities at home or in the workplace.

Another advantage of the present invention is that the device relieves the symptoms of carpal tunnel syndrome.

Another advantage of the present invention is the ability easily use the device at home or in the workplace.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts. A preferred embodiment of these parts will be described in detail in the specification and illustrated in the accompanying drawings, which form a part of this disclosure and wherein.

DESCRIPTION OF THE PREFERRED EMBODIMENT

Figure 1:
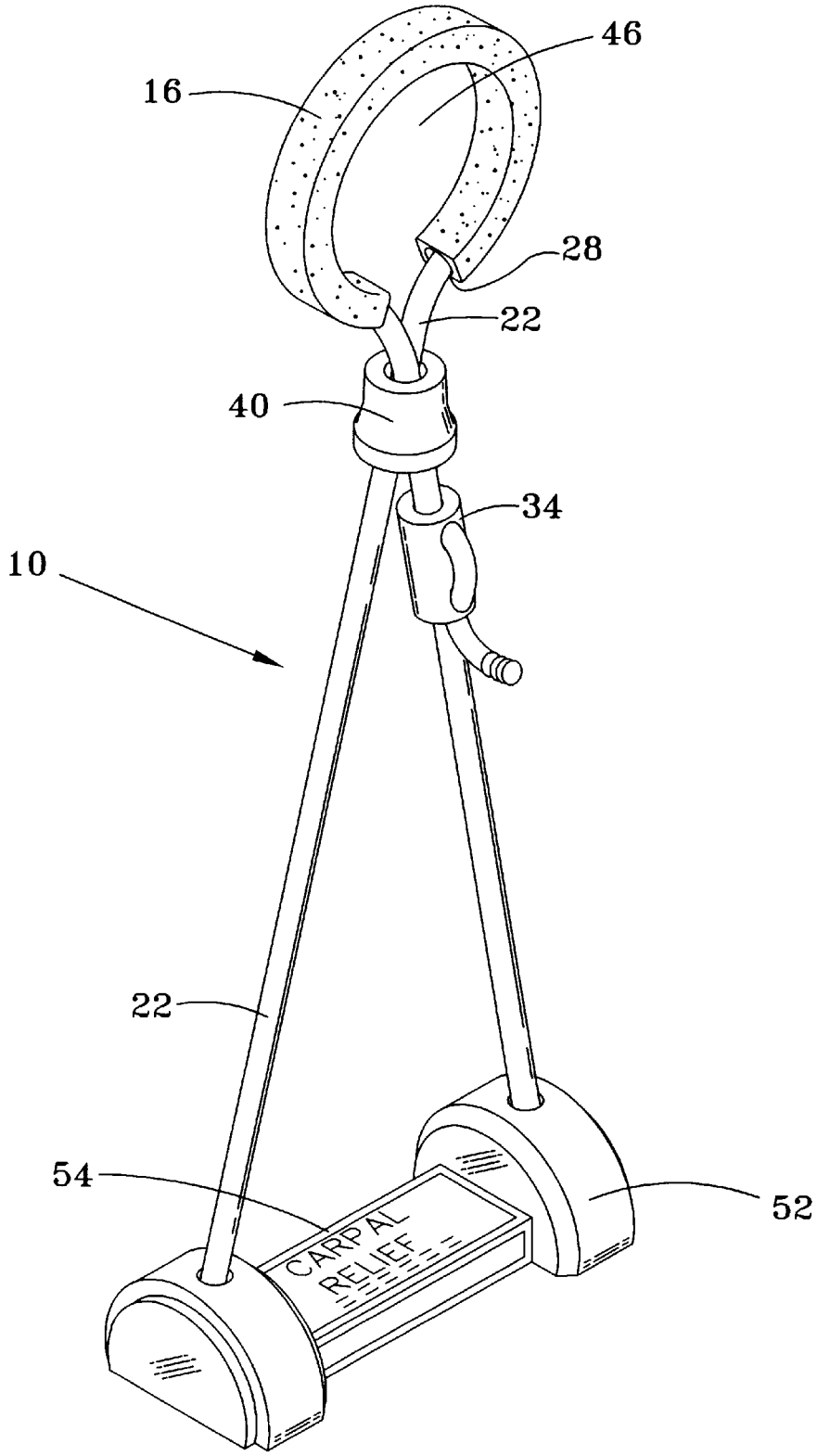
FIG. 1 shows a detailed view of one embodiment of the present invention.

Referring now to the drawings, which are for purposes of illustrating a preferred embodiment of the invention only, and not for purposes of limiting the invention, FIG. 1 shows a wrist relief device 10 for stretching and exercising the wrist. The wrist relief device 10 features a wrist hoop 16 that is designed to slide around the wrist. The wrist hoop 16 is flexible and adjusts to comfortably fit around the wrist. The wrist hoop 16 fits around the wrist, meaning that the wearer does not need to grip the wrist relief device 10 for it to remain in place. The fingers may then remain extended when the device 10 is used. The wrist hoop 16 is preferably made of foam, rubber, or plastic.

A cord 22 is threaded through a hole 28 in the wrist hoop 16. The cord 22 is approximately 4–8 feet long and made of an inelastic material such as cotton rope that does not significantly stretch under tension. The length of the cord 22 is adjustable via adjustment apparatus 34. The adjustment apparatus 34 may be any method of shortening or lengthening the cord 22, though the adjustment apparatus 34 is preferably a cinching device as shown in FIG. 1 that resembles a buckle used with a strap or belt. The cord 22 is snuggled against the wrist of the wearer via a loop lock 40. The loop lock 40 brings two sections of the cord 22 together to form a loop 46 that is filled in by the wrist of the wearer when the device 10 is in use. The wrist hoop 16 is found around the section of cord 22 that forms the loop 46.

A footstep 52 is preferably threaded by the cord 22 at the opposite end of the wrist relief apparatus 10 of the loop 46. To operate the wrist relief device 10, the wrist is placed into the loop 46, and then the loop 46 is tightened utilizing the loop lock 40. The foot of the person using the device 10 is then placed on the footstep 52 on the floor. Finally, the length of the cord 22 should be adjusted so that there will be sufficient tension in the cord 22 when the person stands up.

Once the cord 22 length is adjusted, the person may stand up. The tension of the cord 22 will pull on the wrist and stretch and exercise the carpal tunnel. The footstep 52 may also feature raised bumps 54 or any other traction means such as rubber so that the foot does not slide off of the footstep 52 during use of the device 10.

Figure 2:
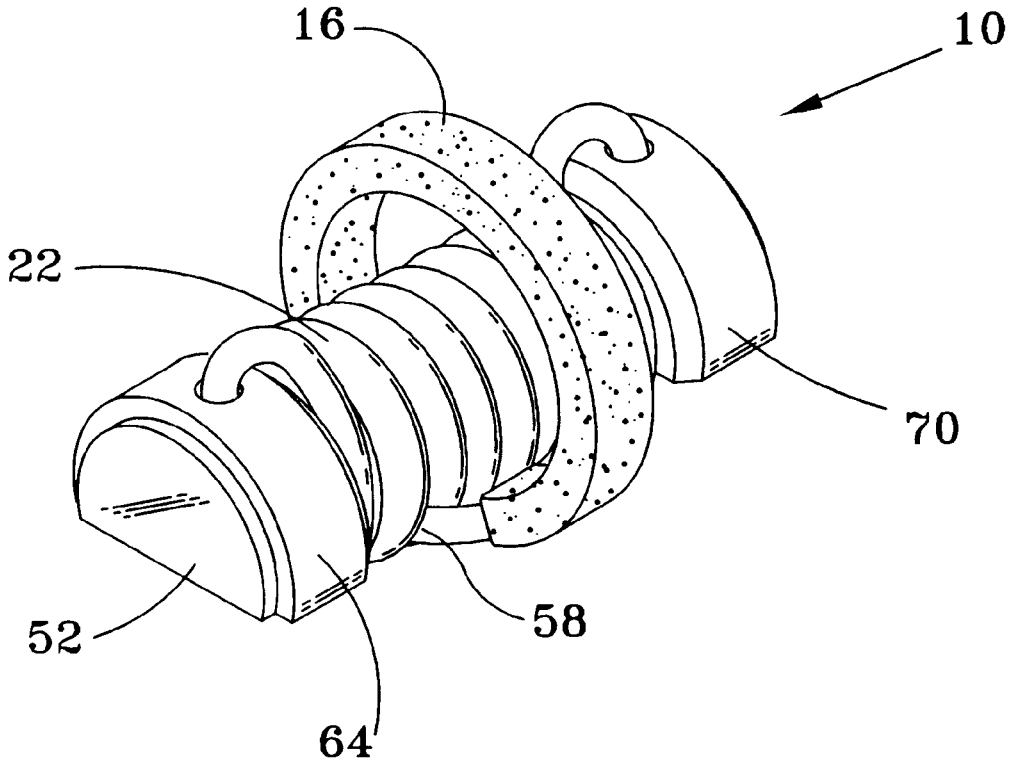
FIG. 2 shows the present invention configured for storage.

FIG. 2 shows a wrist relief device 10 wrapped up to be stored safely. The footstep 52 is preferably designed so that the cord 22 may be wrapped around the footstep 52. The footstep preferably has a recessed inner portion 58 and raised outer portions 64, 70. The cord 22 is preferably wrapped around the inner portion 58, and the outer portions 64, 70 help to hold the cord 22 in place. The wrist hoop 16 also fits around the footstep 52 for storage and to help hold the cord 22 in place.

Figure 3:
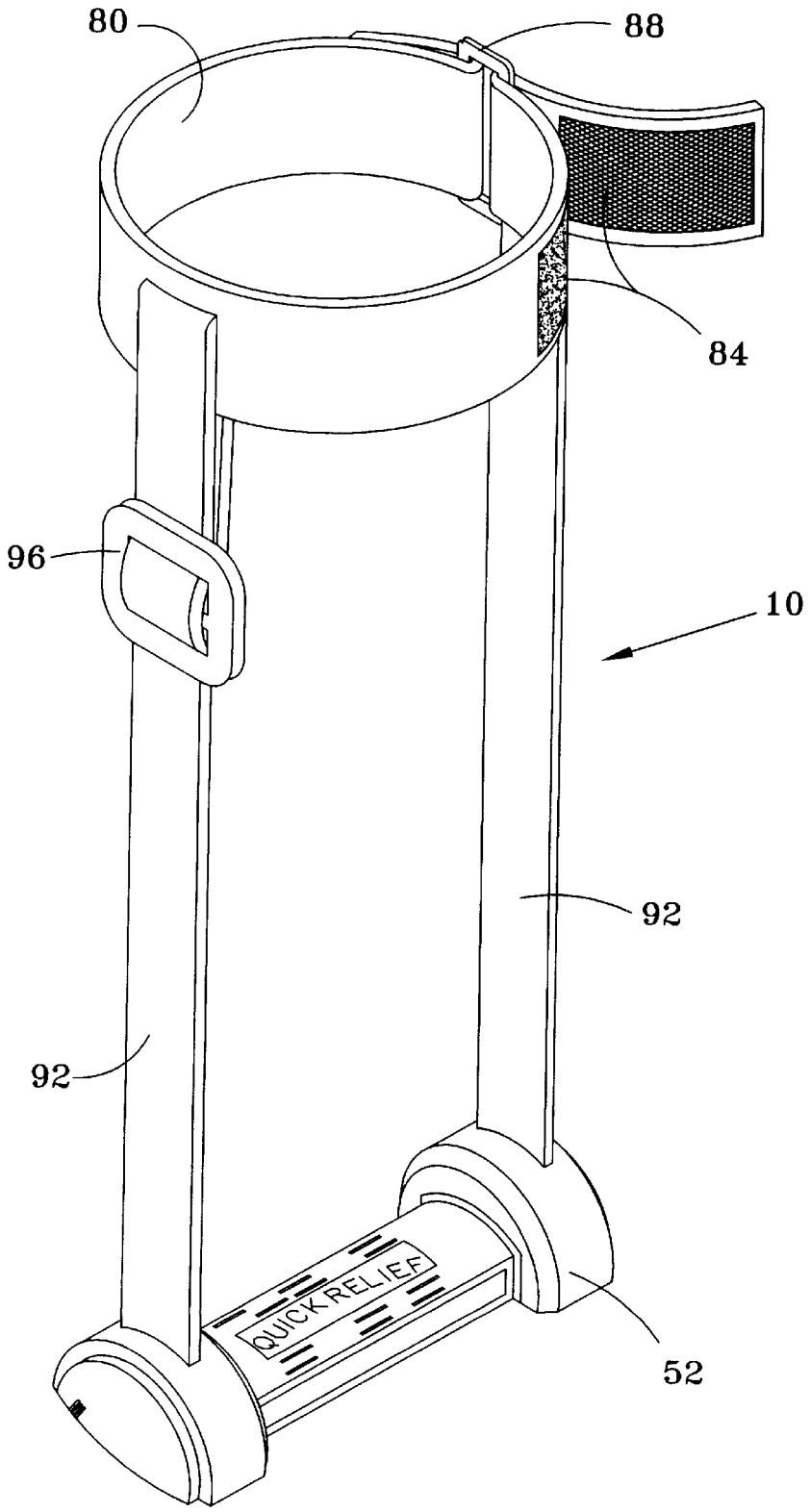
FIG. 3 shows a detailed view of the preferred embodiment of the invention.

FIG. 3 is a detailed view of the preferred embodiment of the wrist relief device 10. A wrist strap 80 is fastened around the wrist of a person using the wrist relief device 10. The wrist strap 80 is preferably made of an inelastic material and preferably includes a hook and loop strip fastener 84 so that the fit of the wrist strap 80 may be adjusted, although any suitable fastener may be used. The wrist strap 80 also contains a buckle 88 so that the circumference of the wrist strap 80 may be adjusted to fit the wrist. The wrist strap 80 is connected to a longer strap 92 that is threaded through the footstep 52 and connected to the wrist strap 80 again. The strap 92 preferably has a length between 4 and 8 feet and preferably is made of an inelastic material, such as nylon, leather, or any other suitable material. The strap 92 also contains a buckle 96 that enables the length of the strap 92 to be adjusted for the person using the wrist relief device 10. As with the previous embodiment, the straps 80, 92 may be wrapped around the footstep 52 for storage of the wrist relief device 10.

The embodiment of the wrist relief device 10 in FIG. 3 operates in the same manner as the previous embodiment. The person using the wrist relief device 10 places his or her hand through the loop created by the wrist strap 80 and secures the wrist strap 80 around the wrist. The length of the strap 92 is then adjusted by the adjusting buckle 96 so that the sufficient tension is placed on the strap 92 to pull on the wrist when the person stands up with his or her foot on the footstep 52. The strap 92 should be adjusted so that it is long enough to allow the person to stand up straight with the wrist secured by the wrist strap 80, and the strap 92 should provide enough tension to extend and relieve the stress on the carpal tunnel regions of the wrist.

The invention has been described with reference to the preferred embodiment. Obviously, modifications and alterations will occur to others upon a reading and understanding of the specification. It is intended by applicant to include all such modifications and alterations insofar as they come within the scope of the appended claims or the equivalents thereof.

Having thus described the invention, it is now claimed:

I claim:

1. An apparatus for alleviating carpal tunnel syndrome comprising:

a cuff for encircling a user's wrist;

a footstep for engaging a user's foot; and a connecting means disposed between said cuff and said footstep for exerting a pulling force on said cuff when the user movers the user's foot and the user's wrist further apart, said connecting means having a first end portion attached to said footstep at a first footstep attachment point and at a second footstep attachment point, wherein said first and second footstep attachment points are disposed on opposite sides of the footstep and a second end portion attached to said cuff at a first attachment point and at a second attachment point, wherein said first and second attachment points are disposed on opposite sides of said cuff, such that said pulling force is evenly distributed around the user's wrist;

wherein said connecting means comprises an inelastic material.

2. The apparatus set forth in claim 1 wherein said connection means is a strap.

3. The apparatus set forth in claim 1 wherein a length of said connection means is adjustable.

4. The apparatus set forth in claim 1 wherein a diameter of said cuff is adjustable.

5. The apparatus set forth in claim 1 wherein said cuff comprises a hook-and-loop closure for adjusting a diameter of said cuff.

6. An apparatus for alleviating carpal tunnel syndrome comprising:

a footstep adapted to be placed beneath the foot of a user in a non-standing position;

a cuff adapted for encircling the user's wrist; and, connecting means adapted to couple said cuff to said footstep and operable to exert a pulling force on said cuff when the user moves the user's wrist further away from the user's foot by moving to a standing position, wherein said connecting means comprises a first end portion extending through said footstep and a second end portion attached to said cuff at a first attachment point and a second attachment point, wherein said first and second attachment points are disposed on opposite sides of said cuff, such that said pulling force is evenly distributed around the user's wrist.

7. The apparatus set forth in claim 6 wherein said connection means is a strap.

8. The apparatus set forth in claim 7 wherein said strap is comprised of an inelastic material.

9. The apparatus set forth in claim 6 wherein a length of said connection means is adjustable.

10. The apparatus set forth in claim 6 wherein a diameter of said cuff is adjustable.

11. The apparatus set forth in claim 6 wherein said cuff comprises a hook-and-loop closure for adjusting a diameter of said cuff.

12. A method of alleviating carpal tunnel syndrome in a user's wrist comprising the steps of:

encircling the user's wrist in a cuff; and connecting the cuff to a footstep beneath the user's foot using a connection means having a first end portion attached to the footstep and a second end portion attached to the cuff at a first attachment point and at a second attachment point, wherein the first and second attachment points are disposed on opposite sides of the cuff; and moving the user's wrist and foot further apart, the movement causing the connection means to exert a pulling force on the cuff, such that the pulling force is evenly distributed around the user's wrist, wherein the step of moving is performed by the user moving from a non-standing position to a standing position.

* * * * *